United States Patent [19]

Stotz

[11] Patent Number: 4,736,678

[45] Date of Patent: Apr. 12, 1988

[54] APPARATUS FOR SELECTIVELY POSITIONING ROLLS IN A CALENDER ROLL STACK

[75] Inventor: Wolf-Gunter Stotz, Ravensburg, Fed. Rep. of Germany

[73] Assignee: Sulzer-Escher Wyss GmbH, Ravensburg, Fed. Rep. of Germany

[21] Appl. No.: 941,368

[22] Filed: Dec. 15, 1986

[30] Foreign Application Priority Data

Dec. 23, 1985 [CH] Switzerland ..... 05492/85

[51] Int. Cl.[4] ..... B30B 15/16

[52] U.S. Cl. ..... 100/163 A; 100/47; 100/159; 100/168; 100/170; 72/243; 91/45; 91/448

[58] Field of Search ..... 100/159, 168, 164, 163 A, 100/170, 47, 162 R; 72/232, 234, 243; 91/45, 448

[56] References Cited

U.S. PATENT DOCUMENTS

| | | | |
|---|---|---|---|
| 3,611,917 | 10/1971 | Bryce | 100/170 X |
| 3,654,833 | 4/1972 | Griffiths | 91/45 X |
| 3,777,656 | 12/1973 | Muller | 100/163 A X |
| 4,299,162 | 11/1981 | Hartmann et al. | 100/170 X |
| 4,597,275 | 7/1986 | Schneid et al. | 72/232 |
| 4,620,477 | 11/1986 | Ripani et al. | 100/168 X |

FOREIGN PATENT DOCUMENTS 1184621 12/1964 Fed. Rep. of Germany .

*Primary Examiner*—Andrew M. Falik
*Attorney, Agent, or Firm*—Werner W. Kleeman

[57] ABSTRACT

A hydraulic adjustment motor containing a piston-and-cylinder unit is provided at the roll surface of a roll to be moved to position the roll surface relative to another roll surface of a further roll. Each adjustment motor is arranged between the related roll surface to be moved and its related roll stand. A regulation device is arranged between a pressure source, the pressure chamber of the adjustment motor and a hydraulic medium vessel. This regulation device regulates impingement of the pressure chamber with different pressures up to the maximum pressure of the pressure source and regulates the outflow of a selected volume of the hydraulic medium out of the pressure chamber, correlated to the desired lowering of each roll surface, during lowering of the roll surface and for maintaining a residual volume of the hydraulic medium. Consequently, there is provided a defined relative position between the roll surfaces. This apparatus allows raising, relieving, lowering or holding of the work surfaces of the rolls in desired positions. The apparatus is suitable for rapidly moving apart individual rolls, such as intermediate rolls of the roll stack. By setting an appropriately reduced pressure in the pressure chamber the apparatus can take-up the weights to be relieved, for instance the overhanging or cantilever weights or marginal loads at the individual roll surfaces and to counteract the same.

16 Claims, 3 Drawing Sheets

APPARATUS FOR SELECTIVELY POSITIONING ROLLS IN A CALENDER ROLL STACK

BACKGROUND OF THE INVENTION

The present invention relates to a new and improved construction of an apparatus for mutually or selectively positioning towards one another roll surfaces of rolls, especially the intermediate rolls in a roll calender. More specifically, the positioning apparatus of the present development is suitable for lifting the roll surfaces, relieving the roll surfaces, lowering the roll surfaces from one work position into another desired position and retaining them in such other desired position.

In particular, such a positioning device serves for rapidly retracting or moving away from one another the roll surfaces throughout a defined path and for relieving the same for the purpose of compensating for undesired weights, among others also the so-called edge or marginal loads at the individual rolls.

Although surely such type of apparatus has also found utility in other technological fields for the positioning of at least two work surfaces relative to one another and which serve to apply pressure to a material layer or web for its treatment, roll calenders for the treatment or finishing of material webs constitutes a typical field of application of the present invention.

It is well-known in this technology that the line force at the contact locations or nip between the roll surfaces, through which there is guided the treated material webs or the like, must be exactly adjustable throughout the web width. This is necessary to ensure that the material web experiences at all locations throughout its entire width a desired web treatment, so that there can be obtained a desired quality of the treated product.

Also very small or minute undesired differences in the individual sections of the treated web can produce unusable products.

To augment the measures which are needed for this purpose there have been developed the so-called controlled deflection rolls or rolls with bending sag compensation, such as typically, for instance, the controlled deflection rolls commercially available under the trademark "NIPCO"-rolls, from the German firm Sulzer-Escher Wyss GmbH, located at Ravensburg, West Germany and which is also the assignee of the present development described herein. By means of these controlled deflection rolls it is possible to variably adjust or set at the contact locations of the mutually coacting rolls the desired line forces, also in zones or discrete regions throughout the web width.

The controlled deflection rolls have also been successfully utilized in multi-roll calenders for the treatment of paper webs, for instance typically as the lowermost and/or the uppermost roll and possibly also as an intermediate roll of the roll stack or set of the calender.

These controlled deflection rolls possess a stationary carrier or beam or yoke about which there is rotatably arranged a roll shell or jacket. Between the stationary carrier or beam and the rotatable roll shell or jacket there are disposed adjustable pressure or support elements, so that the rotatable roll shell or jacket is capable of also altering its position with respect to the stationary carrier or beam and, for instance, is freely movable in the pressing direction of the roll calender or rolling mill.

Apart from what has been previously explained, it is generally known to counteract the effect of the so-called overhanging weights or edge weights by roll relieving, in order to obtain the desired line forces in the individual roll nips. In this regard there is to be understood all of the weights which act externally of the edge of the material web upon the rolls and play a role during the loading of the rolls. These are, by way of example, the weight of the roll bearings and roll supports and different other weights, for instance the scrapers or doctor blades, deflection rolls and similar facilities which must be arranged at such external locations and which influence the loading action, that is to say, the bending-through or sag of the individual rolls.

To avoid the damaging action of the overhanging or cantilever weights there are known, by way of example, the provision of support structures which support the individual rolls at their journals, in other words as far as their force is concerned are directed against the direction of action of these loads or weights.

A further problem in the construction of roll calenders is the so-called rapid relief or relieving of the rolls or roll nips. In this connection there is to be understood a rapid retraction of the rolls in the set or stack from one another. This can be extremely important in the case where a disturbance arises, for instance when a material web which is to be treated ruptures. There are also known for such purpose solutions, for instance as disclosed in U.S. Pat. No. 4,266,475, granted May 12, 1981, wherein, for instance, during the rapid lowering of the lowermost roll of the roll set or stack the individual rolls remain suspended at a sequence of hydraulic arresting devices, so that in this manner they can be spaced from one another. The drawback of this arrangement or construction is that the entire weight of the roll set or stack, in other words all of the rolls are suspended at the holding device of the uppermost roll. However, according to the teachings of this aforementioned U.S. Pat. No. 4,266,475, there are not counteracted the marginal or edge loads.

For the rapid relief of the intermediate rolls and the relevant roll nip, there have been employed complicated and delicate spindles, gears or worm constructions, in order to thus operatively associate with each lowered or sinking roll a respective stop in each roll bearing region, so that at the completion of the roll relieving or nip opening operation the rolls assume or retain a defined spacing from one another.

These adjusting devices which operate as automatically as possible are required in multi-roll calenders for the reasons that there are employed rolls having surfaces formed of different materials, for instance rolls whose surfaces are formed of paper or cotton, wherein the diameter of the roll surface alters depending upon the subsequent roll machining operation or treatment work. Of course, there then also is altered the sum of the diameters of the effective or active regions of the roll bodies in a set or stack of such rolls and thus also the spatial position of the individual rolls.

Such holding devices also often times serve at the same time as facilities for raising a roll, particularly then when a roll of a larger diameter must be interchangeably mounted at the location of a roll of a smaller diameter.

SUMMARY OF THE INVENTION

Therefore, with the foregoing in mind it is a primary object of the present invention to provide a new and improved construction of apparatus for the mutual positioning of roll surfaces of a roll calender in manner which is not afflicted with the aforementioned drawbacks and limitations of the prior art constructions.

Another important object of the present invention aims at providing a new and improved construction of apparatus for the mutual positioning of roll surfaces with respect to one another, which apparatus is capable of fulfilling all of the aforementioned four objectives or functions discussed heretofore, namely, the raising, relieving, lowering or positional retention or holding of the roll surface in a desired position during the so-called "opening" of the roll calender.

A further significant object of the present invention is to provide an apparatus of the character described which is particularly capable of taking-up the so-called marginal or edge loads for compensation purposes.

Still a further important object of the present invention aims at the provision of an apparatus for mutually positioning of roll surfaces of rolls with respect to one another in a roll calender and which apparatus is composed of simple structural elements which have proven themselves in practical utilization and can be easily and reliably adjusted.

Now in order to implement these and still further objects of the invention, which will become more readily apparent as the description proceeds, the present invention contemplates that the apparatus is equipped at both sides of the roll surface of the relevant roll with a respective adjustment or adjusting motor provided with a piston-and-cylinder unit. This adjustment motor can be acted upon or impinged with a suitable hydraulic pressure or pressurized fluid medium. Furthermore, the adjustment motor is arranged between the roll surface and its associated roll stand and has operatively associated therewith a regulation device. This regulation device is arranged between a pressure source, the pressure chamber or compartment of the adjustment motor and a vessel or container for the pressurized fluid medium. Such regulation device serves for regulation of the impingement of pressure chamber or compartment with different fluid medium pressures up to the maximum pressure of the pressure source as well as for the regulation of the outflow or discharge of the pressurized fluid medium out of the pressure chamber for the purpose of attaining a desired lowering path of the roll surface out of it's work position and for retention of a residual volume of the fluid medium in the pressure chamber. Thus, with one and the same apparatus there can be selectively accomplished the four functions, namely the lifting, relieving, lowering and positional retention or holding of the roll surface in desired lowered position, and in a manner such that the lowering path of the roll surface from each momentarily or currently assumed work position into the lowered position which it is to maintain is automatically always of the same magnitude.

Consequently, the objectives of the present invention can be beneficially performed and realized. The apparatus makes use of conventional constructional or structural elements which have proven themselves extremely reliable and suitable in practical applications. Also the regulation or regulating device makes use of known elements and can be easily monitored and operates totally reliably. The lowering path remains automatically of the same magnitude with varying work position of the roll surface.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
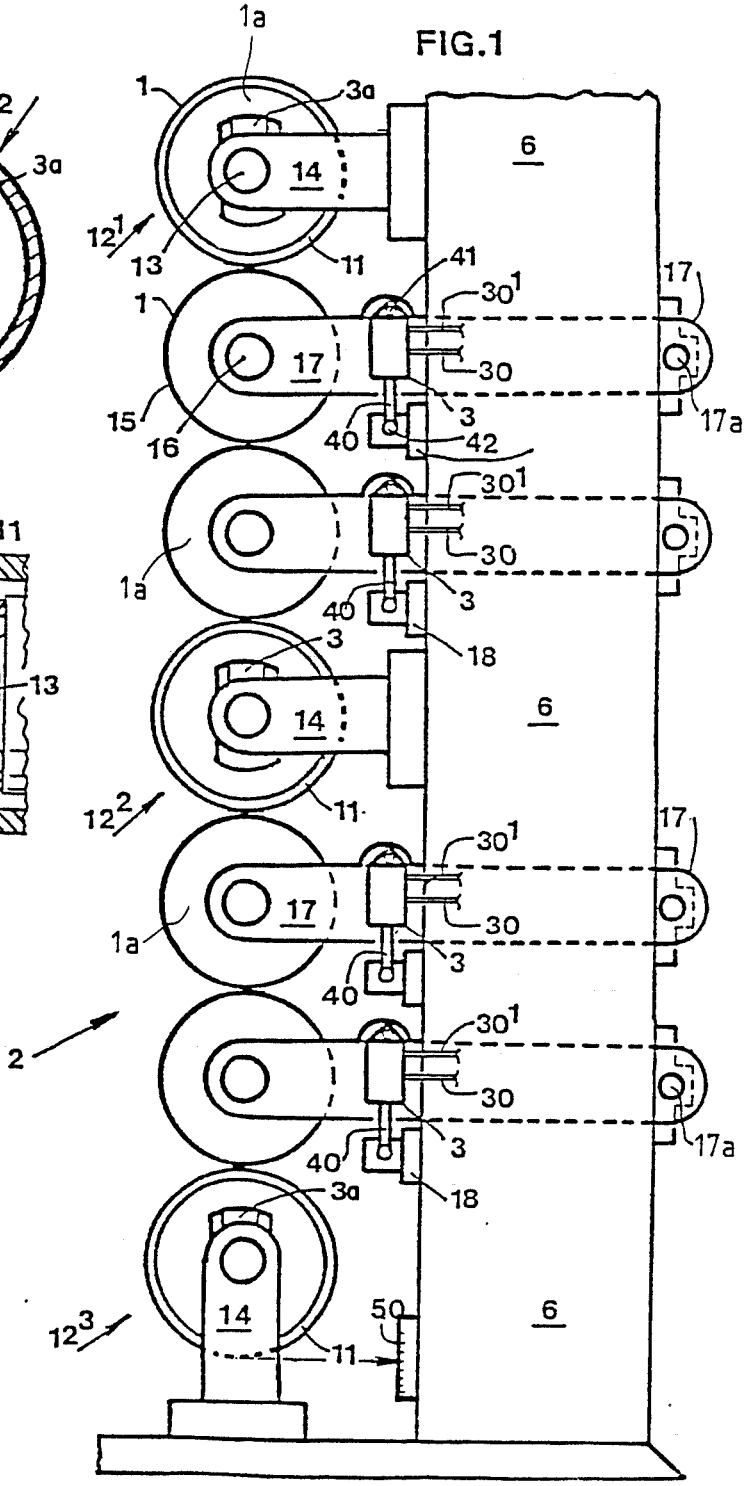
FIG. 1 illustrates in side view a multi-roll calender.

Describing now the drawings, it is to be understood that in order to simplify the illustration thereof only enough of the construction of the inventive apparatus for the mutual positioning of roll surfaces of rolls or rollers of a roll calender has been shown as is needed for those skilled in the art to readily understand the underlying principles and concepts of the present development. Turning now to the drawings and specifically to FIG. 1, one construction of the inventive apparatus will be described, by way of example and not limitation, on the basis of an exemplary embodiment wherein the work or working surfaces are constituted by the roll surfaces 1 of seven work rolls 1*a* arranged in a roll calender 2. By means of the inventive apparatus the roll work surfaces 1, that is to say, the individual rolls 1*a* are selectively raised, relieved, lowered or retained in a desired spatial position when the lowermost roll surface 1*a* is lowered. Additionally, it is possible with the inventive apparatus to upwardly space the individual rolls 1*a* in relation to one another. During roll or nip relieving of the individual rolls 1*a* there is also taken-up the so-called marginal or edge loads, as the same have been previously described, and through the application of a force there is counteracted the effects of the marginal or edge loads upon the deformation of the relevant roll.

A major component or part of the inventive apparatus or equipment is constituted by a hydraulic adjustment or adjusting motor 3 comprising a piston 4 and a cylinder 5 defining a piston-and-cylinder unit 4, 5. The cylinder 5 is arranged at a roll stand or frame 6 and one such cylinder 5 is provided at each respective end of the related roll 1*a*. The adjustment motor 3 is provided in each case between the associated roll surface 1 and its associated roll stand 6. In FIG. 1 there has conveniently been depicted the inventive apparatus only from one side to facilitate the illustration and to improve clarity thereof. It is to be imagined or understood, however, that a mirror-image arrangement of that shown in FIG.

1 also is present at the oppositely situated side of the roll calender 2. As such it should suffice to consider in detail only one side, such as that side shown in FIG. 1, for a complete understanding of the teachings of the present development.

Figure 4:
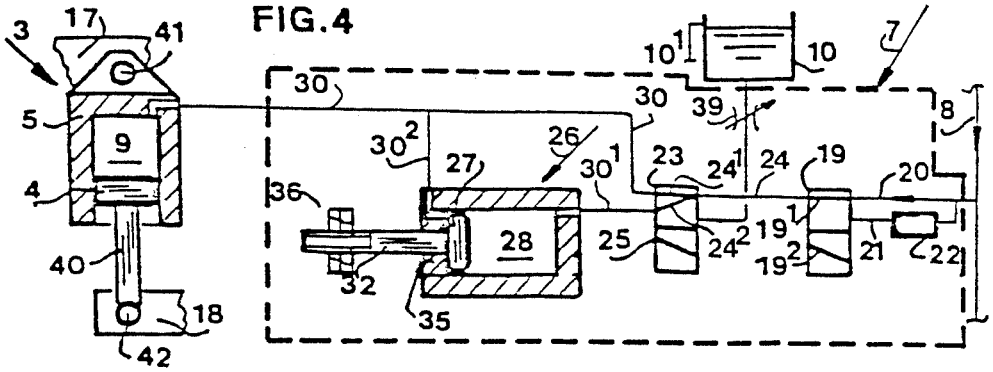
FIGS. 4, 5 and 6 illustrate the inventive apparatus in three different working or operating positions.
Figure 5:
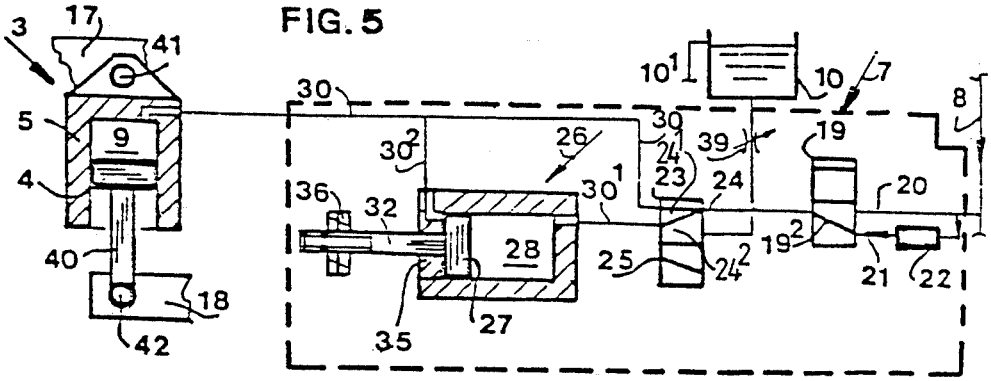
Figure 6:
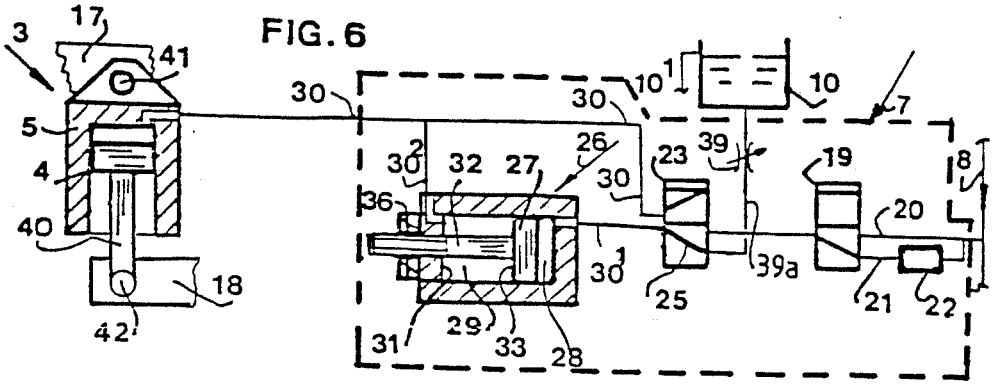
Figure 7:
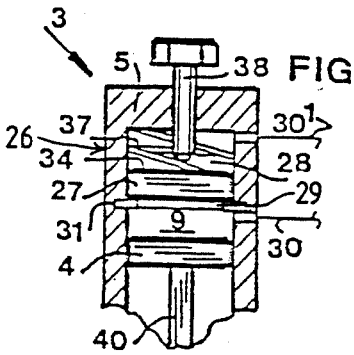
FIG. 7 illustrates in partial sectional view an adjustment motor which is integrated with a piston-and-cylinder unit.

Each adjustment motor 3 is operatively associated with a regulation or regulating device 7 which, as particularly apparent from FIGS. 4, 5 and 6, is provided between a suitable pressure source 8 for the pressurized medium, the pressure chamber or compartment 9 of the correspondingly adjustment motor 3 and a vessel or container 10 for the hydraulic medium, i.e. the pressurized fluid medium. By means of this regulation device 7 it is possible to furnish or impinge the related pressure chamber or compartment 9 with the hydraulic fluid medium at different pressures up to the maximum pressure which can be obtained from the pressure source 8. Additionally, by means of the regulation device 7 it is possible to vent or remove the pressurized fluid or hydraulic medium out of the pressure chamber or compartment 9 to a degree such that there is retained therein a desired residual volume of the medium and this residual volume is then maintained in the pressure chamber or compartment 9. In this manner it is possible with the aid of the regulation device 7 to selectively perform by means of the inventive roll positioning apparatus the four desired or strived four functions, namely the lifting, relieving, lowering or spatial retention or holding of the roll surfaces 1 in desired relative position with respect to one another.

In the depicted roll stack or set of the roll calender 2 there are provided as concerns certain of the rolls three controlled deflection rolls specifically referenced $12^1$, $12^2$ and $12^3$ containing freely mobile or movable roll shells or jackets 11 which are freely movable in the pressing direction. In the illustrated arrangement the roll or roller $12^3$ constitutes the lowermost roll, the roll or roller $12^1$ the uppermost roll or roller, and the roll or roller $12^2$ constitutes the intermediate roll or roller of the roll stack or set.

With the roll calender 2 shown in FIG. 1 there is employed a known regulation or regulating device for instance as disclosed in German Patent Application No. 3,004,657.2 replaced by a subsequent German Application which issued as German Patent Publication No. 3,026,865 and is cognate to U.S. Pat. No. 4,357,743, granted Nov. 9, 1982, and which renders it possible for the entire roll stack or set to be able to assume a stable position, so that there is always realized the desired or intended working forces even then if during the course of time there arise varying diameters of the individual rolls among such individual rolls.

Figure 2:
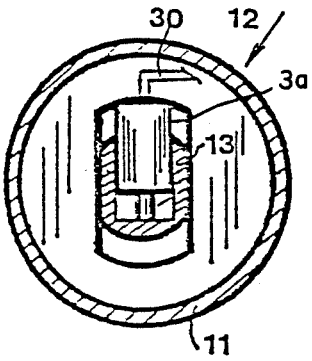
FIG. 2 illustrates in side view, partially in section, a controlled deflection roll used in the calender of the present invention.
Figure 3:
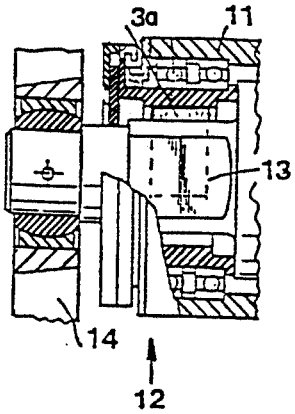
FIG. 3 illustrates partially in an axial sectional view a controlled deflection roll.

As to the other or remaining rolls 1*a* the roll surfaces 1 are constituted by the outer surfaces of the active roll body or roll portion 15. The roll journals 16 are mounted at one end of a related lever or lever member 17. The other end of this lever member 17 is pivotably suspended or mounted at the roll stand 6 as indicated by the related mounting means 17*a*. This pivotal motion of the corresponding roll allows such roll to carry out a movement essentially in vertical direction. On the other hand, the controlled deflection rolls $12^1$, $12^2$ and $12^3$ are mounted in each case at a stationary, non-mobile frame or stand portion 14. In this case the adjustment motor 3*a* is arranged between the mobile roll shell or jacket 11 and the stationary beam or carrier 13 because the stationary beam or carrier 13 of the corresponding controlled deflection roll is immobile in relation to the roll stand or frame 6. This arrangement has been depicted particularly well in FIGS. 2 and 3. Consequently, the adjustment motor 3*a* can move the roll jacket or shell 11 in relation to the associated roll beam or carrier 13, and stated in another way also in relation to the other rolls 1*a* of the roll stack or set or set of the calender 2 in vertical direction and also can relieve the load prevailing at the roll shell or jacket at the region of its opposite ends. In the case of the remaining rolls 1 which are mounted at the levers or lever members 17, the adjustment motor 3 is secured, in each case, on the one hand, that is to say, attached at one end for instance with the cylinder 5 at the related lever member 17 by pins or bolts 41 and, on the other hand, is secured by means of its piston rod 40 of the related piston 4 at the roll stand or frame 6, in this case by means of a pin or bolt 42 at a support part or component 18 which itself is attached to be immobile in relation to the roll stand or frame 6.

The described arrangement of the roll stack or set with the remaining rolls 1*a* guided by means of the lever member 17, as previously explained, has the notable advantage that in this way there is prevented to the greatest possible extent any possible tilting and binding or seizing of the individual rolls in relation to the roll stand 6, as the same frequently previously arose with the heretofore known constructions. Under the aforedescribed term "binding" or "seizing" there is to be understood the binding or seizing of the roll or its carriage guide during its vertical motion.

Figure 10:
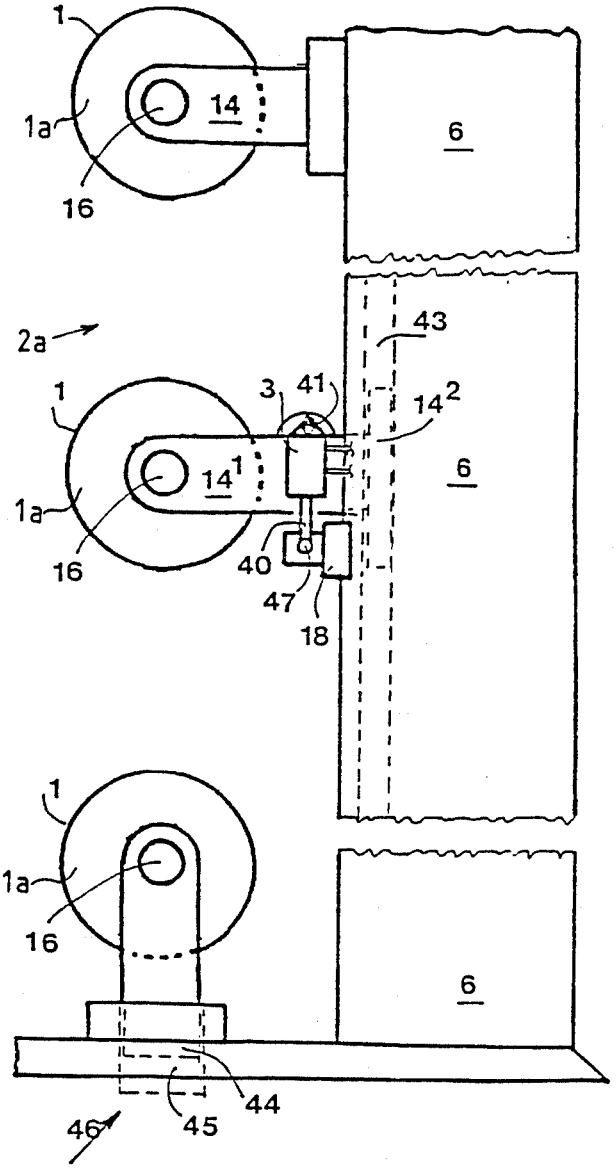
FIG. 10 illustrates a different embodiment of multi-roll calender in partial side view.

In the embodiment depicted in FIG. 10 there is illustrated a roll calender 2*a* in which there are not employed any controlled deflection rolls. All of the rolls 1*a* are conventional rolls, typically solid rolls, containing active roll bodies or roll portions and journals 16. The roll journals 16 of the uppermost roll are mounted in the roll stand portion 14 secured at the roll stand 6. The lowermost roll 1*a* can be raised or lowered by means of a positioning motor 46 equipped with a piston 44 arranged in a pressure chamber or compartment 45. The remaining rolls 1*a* between the uppermost and the lowermost rolls 1*a* are mounted in supports or support members $14^1$. These supports $14^1$ are each provided with an associated carriage component $14^2$ which is vertically displaceable relative to the roll stand 6 by means of the carriage guide 43. The adjustment motor 3 is supported, on the one hand, at the support $14^1$, and on the other hand at the roll stand or frame 6 at the support component or part 18.

As will be particularly well recognized from inspecting FIGS. 4, 5 and 6, the regulation or regulating device 7 is provided for actuating the roll positioning apparatus and the related hydraulic or pressure medium adjustment motor 3 with its cylinder 4, piston rod 40 and pressure chamber or compartment 9. The regulation device 7 is arranged between the associated pressure source 8, the pressure chamber 9 of the adjustment motor 3 and a pressureless vessel or container 10 for the hydraulic or pressurized fluid medium and which vessel or container opens to the atmosphere. It is possible to impinge the pressure chamber 9 with the maximum pressure, in other words the full pressure which can be removed or extracted from the pressure source 8 or with a pressure which has been reduced or diminished according to requirements. For that purpose there is provided a first solenoid or electromagnetic valve 19 and a pressure reduction valve 22.

In FIG. 4 there is illustrated the roll lifting operation or mode. It will be understood that if the solenoid or electromagnetic valve 19 assumes a first position, as depicted in FIG. 4, there prevails in the pressure chamber or compartment 9 of the adjustment motor 3 the full pressure emanating from the pressure source 8 by virtue of the pressure or hydraulic medium which flows through the line or conduit 20, valve channel 19[1] and further through the second solenoid or electromagnetic valve 23 through its channels 24.

As far as FIG. 4 is concerned it should still be mentioned that the there depicted condition constitutes a condition or state representing the so-called lifting mode, that is to say, in this case the individual roll surfaces 1, i.e., the rolls 1*a* are spaced apart from one another through the maximum distance.

FIG. 5 illustrates the relieving operation or mode, commonly referred to in the art also as nip relieving. If it is desired to impinge the pressure chamber or compartment 9 with a reduced pressure, the first solenoid or electromagnetic valve 19 is displaced into a second position which has been depicted in FIG. 5. The pressure emanating from the pressure source 8 is now reduced in the pressure reduction valve 22 to a desired degree and the pressurized fluid medium flows further through the line or conduit 21 and through the now open channel 19[2] of the first solenoid or electromagnetic valve 19 and also through the paths or lines or sections 24[1] and 24[2] in the second solenoid valve 23 and particularly through the path or line 24[1] into the pressure chamber 9. This reduced pressure of the pressurized fluid medium, which is set by means of the pressure reduction valve 22, is exactly of such a magnitude that by virtue of its action or pressure effect in the pressure chamber 9 there is taken-up or counteracted, for instance, the aforementioned overhanging or cantilever weights or marginal or edge loads. Of course, this does not prevent the cylinder 5 of the adjustment motor 3 from moving in vertical direction and freely automatically assuming a work position which is defined by the roll diameter of the individual rolls 1*a* in the roll stack or set or the position of the lowermost roll, for instance the roll 12[3] FIG. 1. This movement is not hindered in any way by the adjustment motor 3.

Rapid roll removal or retraction or so-called rapid nip relief together with roll positioning has been illustrated in FIG. 6. It is accomplished by lowering the rolls in fractions of a second. This initially occurs by lowering the lowermost calender roll, for instance the roll 12[3] in FIG. 1. The lowering of the roll surface 1 thereof occurs by actuating the second solenoid or electromagnetic valve 23 by displacing it into its second position, as has been depicted in FIG. 6. Consequently, the infeed of the hydraulic or pressurized fluid medium from the pressure source 8 through the lines or conduits 24 and 30 to the pressure chamber or compartment 9 is closed. The pressure chamber or compartment 9 is now flow connected by means of the solenoid or electromagnetic valve 23 only still through its channel or section 25 with the container or vessel 10 and into which the hydraulic or fluid medium now can freely flow. As a result, the relative movement between the cylinder 5 and piston 4 results in the piston 4 of course being positioned in the cylinder 5 closer to the cylinder base.

For the purpose of positioning the roll during lowering thereof there is limited the relative movement between the cylinder 5 and the piston 4, namely in the illustrated embodiment the path of movement of the cylinder 5. This can be accomplished by any suitable buffer or stop or the like arranged at the roll stand 6. According to the invention there is provided for this purpose a hydraulic stop or buffer. Such a hydraulic stop is shown by way of example in FIGS. 4 to 9. There is provided a piston-and-cylinder unit 26, wherein a piston 27 thereof delimits from one another or separates two cylinder chambers or compartments 28 and 29. This piston-and-cylinder unit 26 is connected in parallel to the line or conduit 30 which leads to the pressure chamber or compartment 9 of the associated adjustment or adjusting motor 3. The parallel connection is established with regard to the pressure chamber or compartment 28 of the piston-and-cylinder unit 26 by means of a line or conduit 30[1] and with respect to the pressure chamber or compartment 29 by means of a line or conduit 30[2]. In other words, for instance during filling of the pressure chamber or compartment 9 with the hydraulic medium such flows both into the pressure chamber or compartment 9 as well as also into the parallel connected pressure chambers or compartments 28 and 29 of the piston-and-cylinder unit 26 and fills such pressure chambers. In this regard there is, however, ensured that the piston 27 always is shifted or displaced to one side towards a first rest stop or impact surface or member 31 (FIGS. 6 to 9). This is accomplished in the case of the illustration of FIGS. 4, 5, 6 and 7 in that the hydraulically effective surface of the piston 27 is of a different size or dimension in relation to the individual pressure chambers or compartments 28 and 29, respectively. In particular, in the pressure chamber or compartment 29 it is smaller than in the pressure chamber or compartment 28. The reduction in size is accomplished by means of the mounted piston rod 32 which is connected with the piston or piston member 27 and which thus reduces the hydraulically effective surface or face of the piston 27 by the amount of its cross-sectional area. Since the hydraulically effective surface or face of the piston 27 in the first chamber or compartment 28 is greater than in the second pressure chamber or compartment 29, the piston 27 is automatically displaced towards the end face or side or end wall 35 of the pressure chamber or compartment 29 where there is located the stop or impact member 31 for the related piston or piston member 27, even if the same pressure prevails in both pressure chambers 28 and 29 as in the pressure chamber 9.

The parallel connected piston-and-cylinder unit 26 constitutes the element or structure which renders possible the automatic positional assumption of the individual rolls since the same pressure prevails at both sides of the piston or piston member 27, even when changing the position of the piston 4.

Now if there is required the lowering of a given roll there is blocked the part of the line or conduit 30 in relation to the solenoid or electromagnetic valve 23 as the same has been depicted in FIG. 6. The hydraulic or pressure medium now flows from the pressure chamber or compartment 9 through the lines or conduits 30 and 30[2] into the pressure chamber or compartment 29 of the piaron-and-cylinder unit 26. Consequently, the piston 27 is directionally shifted to the other side or end within the pressure chamber 28 and thus expresses or expels the fluid medium located there through the line or conduit 30[1], and this fluid or hydraulic medium now flows through the shifted or activated solenoid or electromagnetic valve 23 through the channel 25 outwardly and into the open vessel or container 10.

According to a typically simplified construction of the apparatus there is provided a stop or impact member 36 at the piston rod 32. This piston rod 32 protrudes out of the piston-and-cylinder unit 26 through the end wall 35 and is equipped with this adjustable stop or impact member 36, as shown. By selectively displacing or positioning the stop or impact member 36 on the piston rod 32 it is possible to optionally limit the path of motion of the piston 27 away from the stop 31 at the end surface or side 35. In the above-described manner there is perfected the above-described hydraulic stop and there can be maintained a desired residual fluid medium volume in the pressure chamber or compartment 9 of the adjustment motor 3.

In order to prevent any possibly arising hard mechanical blows or impacts in the just described situation of the stop or impact adjustment, the outflow of the pressurized medium from the chamber or compartment 28 of the piston-and-cylinder unit can be throttled or dampened. This can be accomplished by means of a throttling device 39 which is arranged in the outflow path from the pressure chamber 9 and the pressure chamber 28, respectively, and specifically in the line or conduit 39*a* leading to the vessel 10 and can be adjusted in time-dependency or displacement path-dependency upon the stroke of the mobile piston 27.

A conventional throttle device (not shown) can be arranged in the line or conduit, for instance between the line or conduit interconnecting the solenoids or electromagnetic valves 19 and 23 for the purpose of dampening oscillations or fluttering in the system between the pressure chamber 9 of the adjustment motor 3 and the pressure source 8.

The illustrated hydraulic system automatically vents. To this end the connections to the individual "pressure chambers or compartments 9 of the adjustment or positioning motor 3, and the pressure chambers 28 and 29 of the piston-and-cylinder unit 26 are always provided at the uppermost location of the related chamber or compartment. Furthermore, the container or vessel 10 which is open to the atmosphere is arranged at the uppermost location or top of the system and is provided with an overflow $10^1$ for connection with the pressure source 8.

It would also be possible, according to requirements, to provide a conventional venting of the system by means of vent valves.

Figure 8:
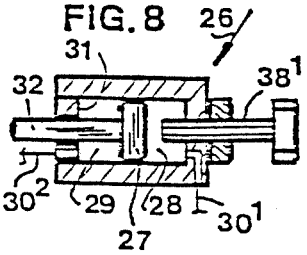
FIG. 8 illustrates a different constructional embodiment of the piston-and-cylinder unit.

In the already described construction of FIGS. 4, 5, 6 and also in the arrangement of FIG. 8 the piston-and-cylinder unit 26 has been depicted in each case as a separate component or part which must be connected by through-lines or conduits with the solenoid or electromagnetic valve 23 as well as also with the pressure chamber or compartment 9. For reasons of security or space-saving reasons there is also proposed an adjustment or adjusting motor 3 which is integrated with the piston-and-cylinder unit. Such an arrangement has been depicted in FIG. 7. The pressure chamber or compartment 9 of the adjustment motor and the pressure chambers 28 and 29 of the piston-and-cylinder unit are accommodated in a common cylinder 5 of the adjustment motor 3, so that the pressure chamber 9 directly merges with the pressure chamber or compartment 29 and not, as described above in conjunction with the piston-and-cylinder unit 26, merges or flow "communicates via lines or conduits. At the interface or boundary between the pressure chamber or compartment 9 and the pressure chamber or compartment 29 there is provided a stop or impact member 31 at which there comes to rest the piston or piston member 27. This result is achieved in that the piston 27 in this case is additionally loaded by means of a spring 37 or other equivalent resilient element which is arranged in the pressure chamber or compartment 28, so that the piston 27 is always shifted towards the stop or impact member 31, even when the pressure of the pressurized medium is the same to both sides or faces of the piston or piston member 27. The path of displacement of the piston 27 away from the stop or impact member 31, can be limited for instance by means of an adjustable positioning or set screw 38 which is directed towards the side or face 34 of the piston 27 which is additionally loaded by the spring 37. The function of this adjustment motor 3 which is integrated with the piston-and-cylinder unit 26 is the same as has been previously described in conjunction with FIGS. 4 to 6. The pressure chamber or compartment 9 is connected with the line or conduit 30 and to the cylinder 5 of this pressure chamber 9 there is also connected the line or conduit $30^1$ which leads to the pressure chamber or compartment 28. In other words, upon introducing the pressure or pressurized medium into the pressure chamber or compartment 9 through the line or conduit 30 there is also simultaneously filled the pressure chamber or compartment 28 with the pressurized medium through the line $30^1$, so that the same pressure prevails at both sides or faces of the piston 27. Due to the action of the spring 37 the piston 27 is, however, displaced into the starting position against the stop or impact member 31. Upon lowering of the roll the solenoid or electromagnetic valve 23 is shifted into the position which has been depicted in FIG. 6 and wherein the line or conduit 30 is closed or shut-off by the solenoid or electromagnetic valve 23 and the line or conduit $30^1$ is connected with the container or vessel 10. In this way the pressurized medium flows directly out of the pressure chamber or compartment 9 into the pressure chamber or compartment 28 behind the stop or impact member 31 while displacing the piston 27 away from the stop or impact member 31 and into the pressure chamber 28, from which there is expressed or expelled the pressure medium until the piston 27 comes to rest at the stop screw 38 or the like. Of course, also in this case there can be provided a throttle valve at the line or conduit $30^1$, such as has been previously described with regard to the throttle valve indicated by reference character 39 in FIGS. 4 to 6.

In FIG. 8 there is illustrated a piston-and-cylinder unit 26 which differs from the piston-and-cylinder units which have been depicted in FIGS. 4, 5 and 6, here through the arrangement of the stop or impact member. The stop is, in this case, not accommodated or arranged at the piston rod 32, rather it is realized by means of an adjustment or adjusting screw $38^1$ which is directed towards the surface or face of the piston 27 which is directed towards or faces the pressure chamber or compartment 28.

Figure 9:
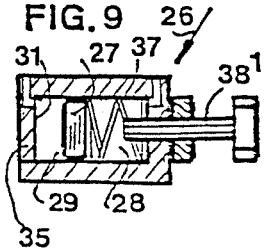
FIG. 9 illustrates a still further embodiment of the piston-and-cylinder unit.

In FIG. 9 there is depicted a different embodiment of the piston-and-cylinder unit 26, which does not possess any piston rod at the piston 27. By means of a compression spring 37, in this case, the piston 27 is displaced or pressed towards the stop or impact member 31.

Instead of the described arrangements for displacement of the piston 27 towards the impact or stop location 31, it would also be possible, in this phase to introduce a greater pressure into the pressure chamber or compartment 28 than prevails in the pressure chamber or compartment 29. This larger pressure is automatically terminated upon the command for the release or escape of the medium out of the pressure chamber or compartment 9.

The invention is not limited in any way only to the equipment illustrated for purposes of explanation and the described exemplary embodiments. This also is true as concerns the regulation device 7 which can also be realized by means of other, for instance electronically controlled means and other valve combinations.

Thus, for instance, the lowering and the lowering displacement path of the cylinder 5 and the roll surface 1, respectively, into a desired position can also be ensured through the use of other means or expedients than the units 7 and 26, respectively, heretofore described. For instance, there can be tsed a so-called timer which generates a signal for termination or blocking of the escape of the pressure medium out of the pressure chamber 9 at such a period of time after the signal for the start of the lowering operation, so that the roll lowering or fluid escape duration determines the magnitude of the desired lowering path. There also can be used, for instance, a displacement path measuring system. This displacement path measuring system tracks or monitors the path of displacement of the cylinder 5 and at the moment of moving through the desired lowering path causes a blocking of the outflow of the pressurized or pressure medium out of the pressure chamber 9, so that the drop height, that is to say, the lowering path of the roll surface 1 is limited. There also can be used a signal for terminating or blocking the escape or outflow of the pressure medium from the pressure chamber 9 through the use of such displacement path measuring system which measures the path of movement of the cylinder 5 away from the elevational position of the roll surface 1 which is present at the moment of the start of the lowering operation. The displacement path measuring system is always provided at or in both of the adjustment motors 3 of the relevant roll surface. The signal for determining the lowering path or limiting the individual drop heights of the individual roll surface can be generated by a common signal transmitter 50. This signal transmitter 50 is provided at least at one side of the roll calender 2 and which controls the individual adjustment motors 3 at both or, if desired, at the relevant side of the roll calender 2. In this regard there also can be provided a rapid or high-speed closing valve instead of the piston-and-cylinder unit 26, which terminates the outflow of the hydraulic medium out of the related adjustment motor 3.

The exemplary embodiments of apparatus for positioning of roll surfaces in a calender can also be used in those instances in press apparatuses or equipment where there are not only employed cylindrical press surfaces but rather also planar or undulated press surfaces which are pressed against one another for treatment of a material web or material and are arranged above one another in a number of levels or tiers.

While there are shown and described present preferred embodiments of the invention, it is to be distinctly understood that the invention is not limited thereto, but may be otherwise variously embodied and practiced within the scope of the following claims.

Accordingly, What I claim is:

1. Apparatus for the selective positioning of roll surfaces of rolls of a roll calendar, which apparatus selectively lifts the roll surfaces, nip relieves the roll surfaces, lowers the roll surfaces from one work position into another desired position and retains such in such desired position, comprising:

a respective adjustment motor arranged at each side of a predetermined roll surface;

a pressure source for pressurized fluid medium;

each such adjustment motor comprising a cylinder and a piston;

said piston and cylinder being arranged for movement relative to one another;

a roll stand cooperating with said predetermined roll surface;

each said respective adjustment motor being disposed between the roll surface and its roll stand;

regulation means provided for the adjustment motors;

each adjustment motor being provided with a pressure chamber;

said regulation means being arranged between the pressure source, the pressure chamber of the adjustment motor and a vessel for the pressurized fluid medium; and said regulation means serving for regulation of the impingement of the pressure chamber with different pressures up to a maximum pressure of the pressure source as well as for the regulation of the escape of the pressure medium out of the pressure chamber for the purpose of obtaining a desired lowering path of the roll surface out of its work position and for maintaining a residual fluid medium volume in the pressure chamber, so that said apparatus selectively accomplishes the lifting, nip relieving, lowering and positional retention of the roll surface in a desired lowered position, yet in a such a manner that said desired lowering path of the roll surface automatically always is of the same magnitude from any currently assumed work position into the lowered position which is to be retained.

2. The apparatus as defined in claim 1, wherein:

a controlled deflection roll defines the predetermined roll surface;

said controlled deflection roll having two oppositely situated ends;

said controlled deflection roll comprising a stationary carrier having oppositely situated ends;

said controlled deflection roll further comprising a rotatable jacket having oppositely situated ends and mounted for rotation about said stationary carrier;

said rotatable jacket having an outer surface constituting said predetermined roll surface;

said rotatable jacket of said controlled deflection roll being movable over its entire length in a predetermined pressing direction with respect to the stationary carrier;

said respective adjustment motor being arranged at a respective one of said two oppositely situated ends of the controlled deflection roll between a related end of the roll jacket and the stationary carrier; and said roll stand including supporting means at which there is supported the stationary carrier at both ends thereof.

3. The apparatus as defined in claim 1, further including:

an active roll body of a roll which defines the predetermined roll surface at its outer surface thereof;

said active roll body having roll journals;

a respective lever member having oppositely situated ends and serving for mounting an associated one of the journals at one end of said lever member;

means for pivotably mounting the other end of said lever member at the roll stand;

said adjustment motor having oppositely situated ends and being supported at one end thereof at the lever member and at the other end thereof at the roll stand.

4. Apparatus for the selective positioning of roll surfaces of rolls of a roll calender, which apparatus is capable of selectively lifting the roll surfaces, nip relieving the roll surfaces, lowering the roll surfaces from one work position into another desired position and retaining such in such desired position, comprising:

a respective adjustment motor arranged at each side of a predetermined roll surface;

a pressure source for pressurized fluid medium;

each such adjustment motor comprising a cylinder and a piston;

said piston and cylinder being arranged for movement relative to one another;

a roll stand cooperating with said predetermined roll surface;

each said respective adjustment motor being disposed between the roll surface and its roll stand;

regulation means provided for the adjustment motors;

each adjustment motor being provided with a pressure chamber;

said regulation means being arranged between the pressure source, the pressure chamber of the adjustment motor and a vessel for the pressurized fluid medium;

said regulation means serving for regulation of the impingement of the pressure chamber with different pressures up to a maximum pressure of the pressure source as well as for the regulation of the escape of the pressure medium out of the pressure chamber for the purpose of obtaining a desired lowering path of the roll surface out of its work position and for maintaining a residual fluid medium volume in the pressure chamber, so that said apparatus is capable of selectively accomplishing the lifting, nip relieving, lowering and positional retention of the roll surface in a desired lowered position, yet in such a manner that said desired lowering path of the roll surface automatically always is of the same magnitude from any currently assumed work position into the lowered position which is to be retained; and said regulation means comprises a first solenoid valve for conducting pressurized medium selectively either at full pressure or at a reduced pressure to the pressure chamber of the adjustment motor.

5. Apparatus for the selective positioning of roll surfaces of rolls of a roll calender, which apparatus is capable of selectively lifting the roll surfaces, nip relieving the roll surfaces, lowering the roll surfaces from one work position into another desired position and retaining such in such desired position, comprising:

a respective adjustment motor arranged at each side of a predetermined roll surface;

a pressure source for pressurized fluid medium;

each such adjustment motor comprising a cylinder and a piston;

said piston and cylinder being arranged for movement relative to one another;

a roll stand cooperating with said predetermined roll surface;

each said respective adjustment motor being disposed between the roll surface and its roll stand;

regulation means provided for the adjustment motors;

each adjustment motor being provided with a pressure chamber;

said regulation means being arranged between the pressure source, the pressure chamber of the adjustment motor and a vessel for the pressurized fluid medium;

said regulation means serving for regulation of the impingement of the pressure chamber with different pressures up to a maximum pressure of the pressure source as well as for the regulation of the escape of the pressure medium out of the pressure chamber for the purpose of obtaining a desired lowering path of the roll surface out of its work position and for maintaining a residual fluid medium volume in the pressure chamber, so that said apparatus is capable of selectively accomplishing the lifting, nip relieving, lowering and positional retention of the roll surface in a desired lowered position, yet in such a manner that said desired lowering path of the roll surface automatically always is of the same magnitude from any currently assumed work position into the lowered position which is to be retained;

said regulation means comprises a solenoid valve arranged upstream of the pressure chamber of the adjustment motor; and conduit means for conducting the pressurized medium into and out of the pressure chamber of the adjustment motor.

6. Apparatus for the selective positioning of roll surfaces of rolls of a roll calender, which apparatus is capable of selectively lifting the roll surfaces, nip relieving the roll surfaces, lowering the roll surfaces from one work position into another desired position and retaining such in such desired position, comprising:

a respective adjustment motor arranged at each side of a predetermiend roll surface;

a pressure source for pressurized fluid medium;

each such adjustment motor comprising a cylinder and a piston;

said piston and cylinder being arranged for movement relative to one another;

a roll stand cooperating with said predetermined roll surface;

each said respective adjustment motor being disposed between the roll surface and its roll stand;

regulation means provided for the adjustment motors;

each adjustment motor being provided with a pressure chamber;

said regulation means being arranged between the pressure source, the pressure chamber of th adjustment motor and a vessel for the pressurized fluid medium;

said regulation means serving for regulation of the impingement of the pressure chamber with different pressures up to a maximum pressure of the pressure source as well as for the regulation of the escape of the pressure medium out of the pressure chamber for the purpose of obtaining a desired lowering path of the roll surface out of its work position and for maintaining a residual fluid medium volume in the pressure chamber, so that said apparatus is capable of selectively accomplishing the lifting, nip relieving, lowering and positional retention of the roll surface in the desired lowered position, yet in such a manner that said desired lowering path of the roll surface automatically always is of the same magnitude from any currently assumed work position into the lowered position which is to be retained;

said cylinder of the adjustment motor being movable along a displacement path; and means for limiting the displacement path of the cylinder of the adjustment motor.

7. The apparatus as defined in claim 6, wherein:

said displacement path limiting means comprises a piston-and-cylinder unit operatively associated with said adjustment motor;

said piston-and-cylinder unit comprising a cylinder and piston;

said piston of said piston-and-cylinder unit dividing said piston into two cylinder chambers;

a line leading to said adjustment motor;

means connecting said two cylinder chambers in parallel with the line leading to the pressure chamber of the adjustment motor;

means defining an impact location for the piston of the piston-and-cylinder unit;

said piston of the piston-and-cylinder unit being loaded in one cylinder chamber with a larger force than in the other cylinder chamber of said two cylinder chambers, so that such piston during simultaneous filling of the pressure chamber of the adjustment motor and the one cylinder chamber with the pressurized fluid medium is displaced towards said means defining an impact location;

said other cylinder chamber having the size thereof limited by such displacement of the piston of the piston-and-cylinder unit;

means connecting said other cylinder chamber with the pressure chamber of the adjustment motor;

a stop device; and the path of the piston of the piston-and-cylinder unit during lowering of the roll surface, being limited in a direction away from the impact location by means of the stop device.

8. The apparatus as defined in claim 7, wherein:

the piston-and-cylinder unit constitutes a separate component;

the piston of said piston-and-cylinder unit having opposite piston faces and possessing a piston rod with which there is connected said piston at one piston face; and said piston rod reducing in size a hydraulically effective surface of said one piston face of the piston in relation to the other piston face of the piston by the amount of its cross-sectional area.

9. The apparatus as defined in claim 8, wherein:

said piston-and-cylinder unit has an end wall;

said piston rod being guided through said end wall of said piston-and-cylinder unit so as to define a protruding piston rod portion; and said stop device comprising an adjustable stop means provided for said protruding piston rod portion and serving for limiting the path of displacement of the piston of the piston-and-cylinder unit.

10. The apparatus as defined in claim 7, wherein:

said piston-and-cylinder unit is integrated with said adjustment motor, so that the pressure chamber of the adjustment motor directly merges with the other cylinder chamber of the piston-and-cylinder unit;

said stop device includes stop means at which starts said other cylinder chamber of the piston-and-cylinder spring means for additionally loading a face of the piston of the piston-and-cylinder unit by the spring pressure thereof; and said stop device comprising a stop adjustable towards said face of the piston of the piston-and-cylinder unit and for limiting the path of the piston from said stop.

11. The apparatus as defined in claim 7, further including:

connection means for the individual pressure chambers of the adjustment motor and the piston-and-cylinder unit;

said connection means being provided at an uppermost location of the related pressure chamber for the self-venting of the hydraulic system; and said vessel being arranged at an uppermost location of the system.

said regulation means comprises a solenoid valve arranged upstream of the pressure chamber of the adjustment motor;

conduit means for conducting the pressurized medium into and out of the pressure chamber of the adjustment motor;

a line arranged between the pressure chamber and the pressure source; and a throttle device arranged in said line and serving for damping oscillations in the system between the pressure chamber of the adjustment motor and the pressure source.

12. The apparatus as defined in claim 12, wherein:

said regulation means comprises a solenoid valve arranged upstream of the pressure chamber of the adjustment motor;

conduit means for conducting the pressurized medium into and out of the pressure chamber of the adjustment motor;

a line arranged between the pressure chamber and the pressure source; and a throttle device arranged in said line and serving for damping oscillations in the system betweem the pressure chamber of the adjustment motor and the pressure source.

13. Apparatus for the selective positioning of roll surfaces of rolls of a roll calender, which apparatus is capable of selectively lifting the roll surfaces, nip relieving the roll surfaces, lowering the roll surfaces from one work position into another desired position and retaining such in such desired position, comprising:

a respective adjustment motor arranged at each side of a predetermined roll surface;

a pressure source for pressurized fluid medium;

each such adjustment motor comprising a cylinder and a piston;

said piston and cylinder being arranged for movement relative to one another;

a roll stand cooperating with said predetermined roll surface;

each said respective adjustment motor being disposed between the roll surface and its roll stand;

regulation means provided for the adjustment motors;

each adjustment motor being provided with a pressure chamber;

said regulation means being arranged between the pressure source, the pressure chamber of th adjustment motor and a vessel for the pressurized fluid medium;

said regulation means serving for regulation of the impingement of the pressure chamber with different pressures up to a maximum pressure of the pressure source as well as for the regulation of the escape of the pressure medium out of the pressure chamber for the purpose of obtaining a desired lowering path of the roll surface out of its work position and for maintaining a residual fluid medium volume in the pressure chamber, so that said apparatus is capable of selectively accomplishing the lifting, nip relieving, lowering and positional retention of the roll surface in a desired lowered position, yet in such a manner that said desired lowering path of the roll surface automatically always is of the same magnitude from any currently assumed work position into the lowered position which is to be retained; and a throttle device for regulating the outflow of the pressurized fluid medium out of the pressure chamber.

14. The apparatus as defined in claim 13, wherein:

said throttle device is structured to have a throttle action which can be altered during lowering of the roll surface.

15. The apparatus as defined in claim 14, wherein:

said throttle device is structured to possess a throttling action which is dependent upon the lowering of the roll surface.

16. Apparatus for the selective positioning of roll surfaces of rolls of a roll calender, which apparatus is capable of selectively lifting the roll surfaces, nip relieving the roll surfaces, lowering the roll surfaces from one work position into another desired position and retaining such in such desired position, comprising:

a respective adjustment motor arranged at each side of a predetermined roll surface;

a pressure source for pressurized fluid medium;

each such adjustment motor comprising a cylinder and a piston;

said piston and cylinder being arranged for movement relative to one another;

a roll stand cooperating with said predetermined roll surface;

each said respective adjustment motor being disposed between the roll surface and its roll stand;

regulation means provided for the adjustment motors;

each adjustment motor being provided with a pressure chamber;

said regulation means being arranged between the pressure source, the pressure chamber of th adjustment motor and a vessel for the pressurized fluid medium;

said regulation means serving for regulation of the impingement of the pressure chamber with different pressures up to a maximum pressure of the pressure source as well as for the regulation of the escape of the pressure medium out of the pressure chamber for the purpose of obtaining a desired lowering path of the roll surface out of its work position and for maintaining a residual fluid medium volume in the pressure chamber, so that said apparatus is capable of selectively accomplishing the lifting, nip relieving, lowering and positional retention of the roll surface in a desired lowered position, yet in such a manner that said desired lowering path of the roll surface automatically always is of the same magnitude from any currently assumed work position into the lowered position which is to be retained;

the roll surface is defined by a roll which has roll journals at opposite end thereof;

support means for mounting the roll journals of the roll;

said support means having carriage means displaceably arranged in carriage guides of the roll stand; and each said adjustment motor being supported at one end at a related one of said support means and at the other end at the roll stand.

* * * * *

UNITED STATES PATENT AND TRADEMARK OFFICE

CERTIFICATE OF CORRECTION

PATENT NO. : 4,736,678

DATED : April 12, 1988

INVENTOR(S) : WOLF-GUNTER STOTZ

It is certified that error appears in the above-identified patent and that said Letters Patent is hereby corrected as shown below:

Column 6, line 53, after "cylinder" please delete "4" and insert --5--

Column 8, line 59, please delete "piaron-and-cylinder" and insert --piston-and-cylinder--

Column 11, line 14, after "be" please delete "tsed" and insert --used--

Column 14, line 56, after "of" please delete "th" and insert --the--

Column 16, line 35, please delete "12" and insert --11--

Column 16, lines 23 to 34, please delete in their entirety.

Column 17, line 2, after"of" please delete "th" and insert --the--

Column 18, line 14, please delete "th" and insert --the--

Signed and Sealed this

Twenty-ninth Day of November, 1988

*Attest:*

*Attesting Officer*

DONALD J. QUIGG

*Commissioner of Patents and Trademarks*